US008403700B2

(12) United States Patent
Zhu

(10) Patent No.: US 8,403,700 B2
(45) Date of Patent: Mar. 26, 2013

(54) ELECTRICAL CONNECTOR WITH ALIGNMENT BOARD SLOT

(75) Inventor: Yu Zhu, Shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 198 days.

(21) Appl. No.: 12/886,103

(22) Filed: Sep. 20, 2010

(65) Prior Publication Data

US 2011/0124230 A1 May 26, 2011

(30) Foreign Application Priority Data

Nov. 24, 2009 (CN) ..... 2009 2 0315539

(51) Int. Cl.
*H01R 13/60* (2006.01)

(52) U.S. Cl. ..... 439/540.1

(58) Field of Classification Search ..... 439/189, 439/325, 540, 542, 630
See application file for complete search history.

(56) References Cited

U.S. PATENT DOCUMENTS

2001/0039129 A1* 11/2001 Nishimura ..... 439/74

* cited by examiner

*Primary Examiner* — Vanessa Girardi
(74) *Attorney, Agent, or Firm* — Wei Te Chung; Ming Chieh Chang

(57) ABSTRACT

An electrical connector includes an insulative housing and a plurality of terminals received in the housing. The insulative housing includes a longitudinal uninterrupted mating cavity extending in a first direction and through a front face thereof in a second direction perpendicular to the first direction. A plurality of terminals is retained at a first wall of the insulating housing and comprising contacting portions exposing in the mating cavity. The uninterrupted mating cavity comprises a horizontal main slot extending in the first direction, a first auxiliary slot located at the first wall and a pair of second auxiliary slot at two opposite ends of the horizontal main slot in the first direction.

13 Claims, 4 Drawing Sheets

ELECTRICAL CONNECTOR WITH ALIGNMENT BOARD SLOT

BACKGROUND OF THE INVENTION

The present invention relates to an electrical connector which is adapted for two different complementary equipments, such as a complementary connector and a printed circuit board.

2. Description of Related Art

A popular standard of electrical connector which is widely used in the storage device is called "Serial Advanced Technology Attachment (Serial ATA)". U.S. Pat. No. 6,773,293 issued on Aug. 10, 2004 to George Lee discloses a connector assembly generally named as Serial ATA Connector including a cable connector and a board connector. The cable connector has a longitudinal L-shaped mating slot with a plurality of first terminals protruding therein. The board connector has an L-shaped tongue portion with a plurality of terminals inserted therein for mating with the slot of the cable connector.

Sometimes, a board electrical connector adapted for being inserted by different types of complementary equipment is needed in the miniaturization and diversified tendency of electronic device. The complementary equipment is of cable electrical connector generally, for example, the cable connector in U.S. Pat. No. 6,773,293. A printed circuit board etched with golden fingers taken place of the cable connector is hoped to also be inserted in the electrical connector in consideration of diversified tendency. However, dimensions of the mating portions in the slot of the cable connector and the printed circuit board are different, a co-port electrical connector is desired.

BRIEF SUMMARY OF THE INVENTION

The present invention provides an electrical connector including an insulative housing and a plurality of terminals received in the housing. The insulative housing includes a longitudinal uninterrupted mating cavity extending in a lengthwise direction and through a front face thereof in a mating direction perpendicular to the lengthwise direction. A plurality of terminals is retained at a first lengthwise wall of the insulating housing and comprising exposed contacting portions in the mating cavity. The uninterrupted mating cavity comprises a horizontal main slot extending in the lengthwise direction with a standard length s1, a first auxiliary slot located at the first lengthwise wall and a pair of second auxiliary slot at two opposite ends of the horizontal main slot in the lengthwise direction to form an expanded length s2 larger than the standard length s1.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which:

FIG. 3 is a front schematic view of the electrical connector with the circuit board received in.

DETAILED DESCRIPTION OF THE PREFERRED EMBODIMENTS

Figure 1:
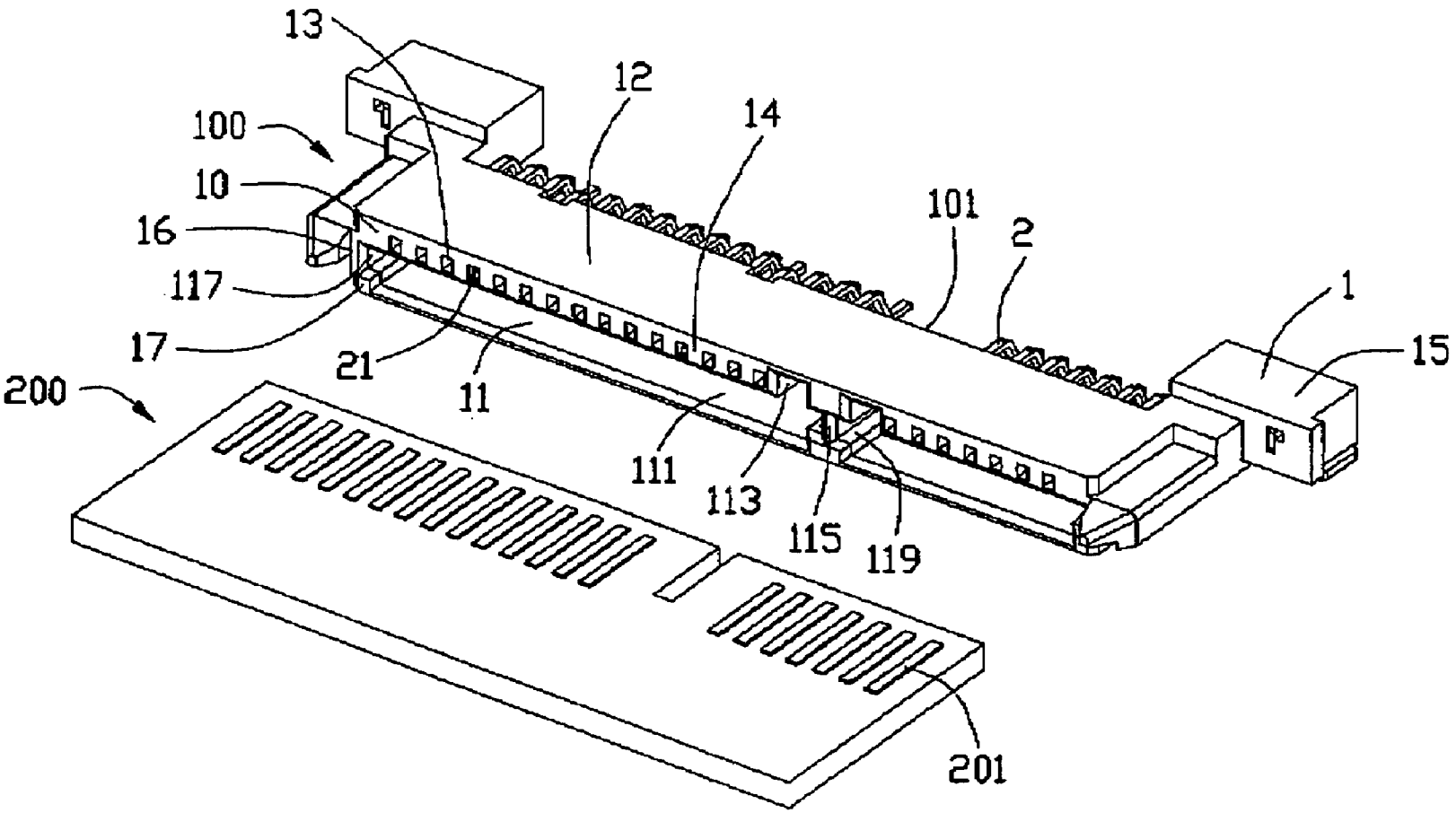
FIG. 1 is a perspective view of the electrical connector disconnecting with a circuit board.

Reference will now be made to the drawing figures to describe the preferred embodiment of the present invention in detail.

Referring to FIG. 1 an electrical connector 100 for mating with a standard Serial ATA board connector (not shown) or a printed circuit board 200 is shown, which includes an insulative housing 1 defining a forwardly protruding mating portion 12 with a front face 10 and an opposite back face 101. The insulative housing 1 defines a first lengthwise wall 14 extending along a lengthwise direction, a second lengthwise wall 141 opposite to the first lengthwise wall 14 and two opposite lateral walls 16 linking two opposite ends of said two lengthwise walls perpendicular to said lengthwise direction. The mating portion 12 has two substantially L shaped mating cavities 11 side-by-side divided by a partition 115, including a first mating cavity and a second mating cavity. The two mating cavities extending lengthwise have similar shape except the length and orientation of letter L, so one mating cavity is described hereinafter. Each mating cavity 11 is defined running though the front face 10 along a mating direction perpendicular to both the lengthwise direction and a vertical direction. A plurality of spaced passageways 13 configured to extend from the front face 10 to the back face 101 are disposed along the first lengthwise wall 14 of the mating cavity 11 to communicate with the mating cavity 11. A plurality of terminals 2 are inserted in the passageways 13 in a front-and back direction from the back face 101 to the front face 10 of the mating portion 12 with front tip 21 pro-loading on the first lengthwise wall near the front face. Please note, the passageways 13 in left mating cavity in the drawing sheet receive power terminals and passageways 13 in the right mating cavity receive signal terminals.

Figure 2:
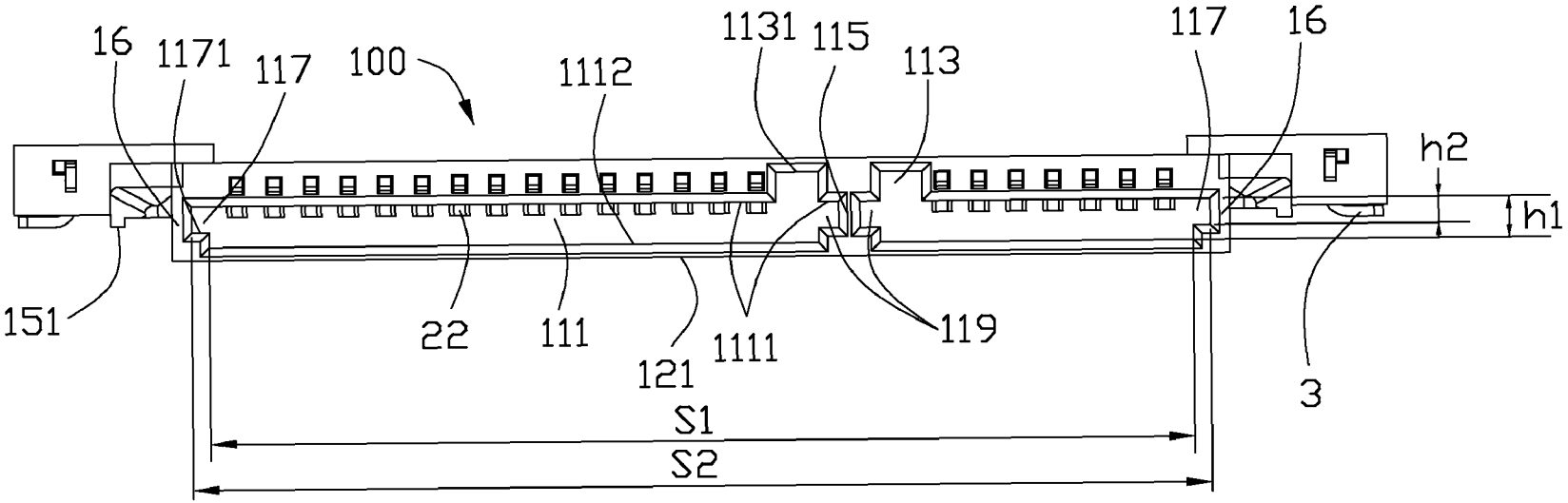
FIG. 2 is a front view of the electrical connector.
Figure 3:
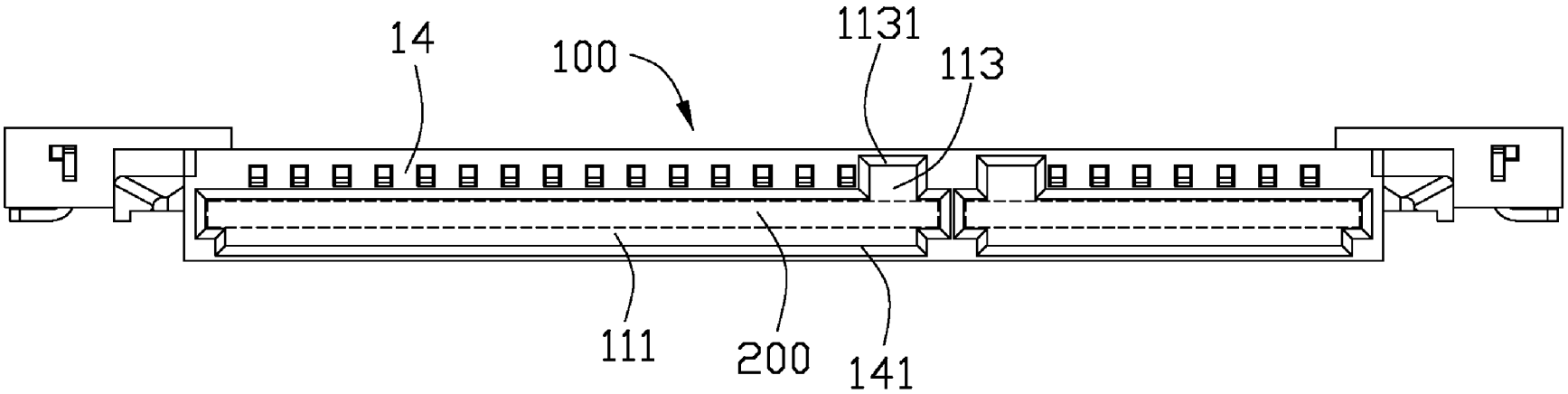

Combination with FIGS. 1 and 2, each of the two mating cavity 11 is uninterrupted and includes a horizontal main slot 111 and a vertical first auxiliary slot 113 disposed at one end of the horizontal main slot 111 and closed to the partition 115. The mating cavity 11 further includes a pair of second auxiliary slots 117, 119 at two ends of the main slot 111. The pair of the second auxiliary slot horizontally extends from two ends of the main slot 111 and communicates with the main slot 111, one second auxiliary slot 119 is adjacent to the first auxiliary slot 113. Please note and refer to FIG. 2, the contacting portions 22 of the contacts expose only in the main slot 111 while the first auxiliary slot 113 and the second auxiliary slots 117,119 has no contacting portions therein. The second auxiliary slots 117,119 and the main slot has a coplanar top inside face 1111 while the bottom face 1112 of the main slot is lower than the bottom inside faces 1171 of the second auxiliary slot 117,119. The top inside face 1131 of the first auxiliary slot is higher than the top inside face 1111. Thus the main slots 111 with a standard first height h1 and the first auxiliary slots 113 together are shaped compatibly for a standard Serial ATA connector while the main slots 111 and the pairs of second auxiliary slots 117, 119 with second width h2 together are shaped for the circuit board 200. The width h1 is smaller than the width h2 since the circuit board 200 is thinner so as to hold the circuit board 200 in mating cavities as shown in FIG. 3. The circuit board 200 spaces from the second lengthwise wall 141 opposite to the first lengthwise wall 14, and supports and limits by the second auxiliary slots 117, 119 in the lengthwise direction and the vertical direction. In other words, the insulative housing 10 defines first and second spaced protrusions 17 at two opposite lateral ends of and invading the main slot 111 to form the second height h2. The first auxiliary slot 113 is used for supporting and anti-mismating of a complementary connector.

Referring particularly to FIGS. 1 and 2, the insulative housing 10 further includes a pair of mounting ears 15 located at opposite ends of a back portion of the insulative housing 1, the mounting ears 15 defining a board mounting face 151 adapted to be mounted onto a mounting board (not shown). The mating portion 12 also includes a bottom face 121 extending between the front face 10 and the back face 101 and locatable below the board mounting face 151 of the mounting ears 15. In addition, a pair of soldering pad 3 is positioned at opposite sides of the mounting ears 15, with each having a soldering plane being coplanar with the board mounting face 151.

Figure 4:
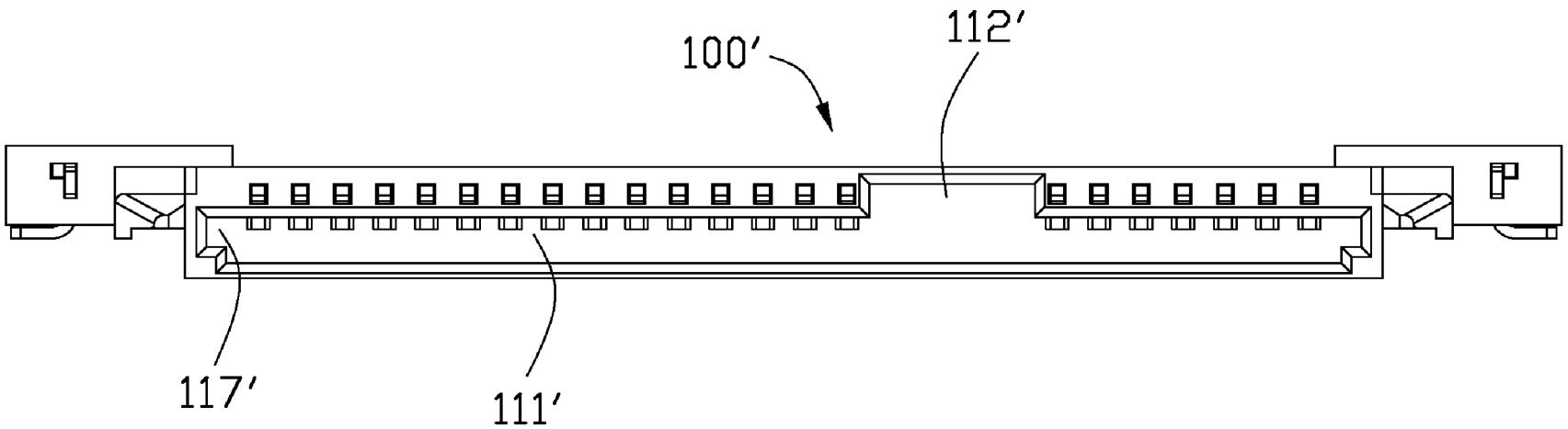
FIG. 4 is a front view of an electrical connector of another embodiment.

Referring to FIG. 4, another embodiment of this invention is known as a Serial Attached SCSI (SAS) standard which has similar structure with Serial ATA. Hereafter, difference between them will be mainly introduced. The connector 100' further forms a uninterrupted longitudinal mating cavity which includes a horizontal main slot 111', a first auxiliary slot 112' and a pair of second auxiliary slot 117'. The first auxiliary slot 112' is located near a middle portion of the main slot. The first auxiliary slot 112' divides the passageways into two groups, the left one is for receiving power terminals and the other is for receiving power terminals. Without forming the partition, only two second auxiliary slots 117' are extended along both longitudinal ends of the main slots 111' for engaging the both board edges of the circuit board (not shown).

It is to be understood, however, that even though numerous, characteristics and advantages of the present invention have been set forth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector, which is derived from a Serial ATA board connector, comprising:

an insulative housing defining a longitudinal uninterrupted mating cavity extending in a lengthwise direction and through a front face thereof in a mating direction perpendicular to the lengthwise direction;

a plurality of terminals retained at a first lengthwise wall of the insulating housing and comprising exposed contacting portions in the mating cavity;

the uninterrupted mating cavity comprising a main slot extending in the lengthwise direction with a standard length, at least one first auxiliary slots located at the first lengthwise wall and a pair of second auxiliary slot at two opposite ends of the main slot along the lengthwise direction;

wherein the insulative housing further defines a board mounting face, and a mating portion having an exterior bottom face extending between the front face and a back face, and the bottom face of the mating portion is located below the board mounting face.

2. An electrical connector, which is derived from a Serial ATA board connector comprising:

an insulative housing defining two longitudinal uninterrupted mating cavities extending in a lengthwise direction and through a front face thereof in a mating direction perpendicular to the lengthwise direction;

a plurality of terminals retained at a first lengthwise wall of the insulating housing and comprising exposed contacting portions in at least one of the mating cavities; the uninterrupted mating cavities are encompassed within a main slot extending in the lengthwise direction with a standard length, at least one first auxiliary slot located at the first lengthwise wall and a pair of second auxiliary slots at two opposite ends of the main slot along the lengthwise direction;

wherein the main slot and the pair of the second auxiliary slots have a coplanar top inside face at the first lengthwise wall, a bottom inside face opposite to the top inside face of the main slot is lower than that of the pair of second auxiliary slots;

wherein the first auxiliary slot has a top inside wall which is higher than the top inside wall of the main slot; wherein the two uninterrupted mating cavities are spaced by a partition, and an additional first auxiliary slot adjacent the partition.

3. The electrical connector as claimed in claim 2, wherein the main slot and the first auxiliary slot together are shaped to accommodate a standard Serial ATA connector whereas the main slot and the pair of second auxiliary slot together are shaped to accommodate a circuit board inserted in the mating cavity.

4. The electrical connector as claimed in claim 2, wherein the main slot and the first auxiliary slot together are shaped to accommodate a standard Serial Attached SCSI (SAS) connector intending to be inserted in the mating cavity whereas the main slot and the pair of second auxiliary slots together are shaped to accommodate a circuit board inserted in the mating cavity.

5. An electrical connector for mating with a board-like module defining a thickness thereof, comprising:

an elongated housing defining two opposite lengthwise walls extending along a lengthwise direction, and two opposite lateral walls linking two opposite ends of said lengthwise walls perpendicular to said lengthwise direction;

a first mating cavity uninterruptedly defined in said elongated housing, said first mating cavity including a main slot horizontally extending along said lengthwise direction having a first height, which is defined in a vertical direction, larger than said thickness of board-like module except at two laterally spaced first and second positions in the housing which further defines two spaced protrusions invading the main slot to form a second height, along said horizontal direction, slightly larger than said thickness of the board-like module to be held in the main slot; wherein one of said two opposite lengthwise walls is equipped with terminals for mating with the board-like module, and said two spaced protrusions are formed on the other of said two opposite lengthwise side walls; and a vertical auxiliary slot toward one end the main slot provides a keying function, and is formed in said one of the two opposite lengthwise walls adjacent to one of two opposite lengthwise ends of the main slot while laterally offset from one of said two spaced protrusions.

6. The electrical connector as claimed in claim 5, wherein all terminals of the connector are disposed in said one of the two opposite lengthwise walls.

7. The electrical connector as claimed in claim 5, wherein said first and second positions are located at the two opposite lateral ends of the main slot.

8. The electrical connector as claimed in claim 5, wherein said housing further includes a second mating cavity, having a main slot, spaced from the first mating cavity across a partition wall along said lengthwise direction.

9. The electrical connector as claimed in claim 8, wherein said first and second positions are located at the two opposite lateral ends of the main slot such that one of said two spaced protrusions, which invades the main slot is located adjacent the partition wall.

10. The electrical connector as claimed in claim 8, wherein one of the two spaced protrusions, which invades the main slot of the second mating cavity, is located adjacent the partition wall.

11. The electrical connector as claimed in claim 5, wherein said housing further includes a second mating cavity, having a main slot, spaced from the first mating cavity across a partition wall along said lengthwise direction the auxiliary slot of said first mating cavity is located adjacent to one side of said partition wall and an auxiliary slot of the second mating cavity is adjacent to an opposite side of said partition wall.

12. The electrical connector as claimed in claim 11, wherein said first and second positions are located at the two opposite lateral ends of the main slot such that one of said two spaced protrusions, which invades the main slot, is located adjacent the partition wall.

13. The electrical connector as claimed in claim 12, wherein one of the two spaced protrusions, which invades a corresponding main slot of the second mating cavity, is located on an opposite side of the partition wall.

* * * * *